US005683298A

United States Patent [19]

Jackson

[11] Patent Number: 5,683,298

[45] Date of Patent: Nov. 4, 1997

[54] TIERED OBSTACLE COURSE SYSTEM FOR REMOTELY CONTROLLED VEHICLES

[76] Inventor: Perry L. Jackson, 38319 N. Robert Wilson Rd., Gonzales, La. 70737

[21] Appl. No.: 756,818

[22] Filed: Nov. 26, 1996

[51] Int. Cl.[6] ..... A63F 9/14; A63M 18/00

[52] U.S. Cl. ..... 463/58; 463/59; 273/442; 446/444

[58] Field of Search ..... 273/442, 440, 273/441; 446/168, 444, 476; 463/58, 59, 62, 63

[56] References Cited

U.S. PATENT DOCUMENTS

| | | | |
|---|---|---|---|
| 1,590,242 | 6/1926 | Howard | 446/168 |
| 3,352,251 | 11/1967 | Einfalt | 446/444 X |
| 3,502,332 | 3/1970 | Wolf . | |
| 3,820,788 | 6/1974 | Goldfarb . | |
| 3,908,989 | 9/1975 | Meyer | 273/442 X |
| 4,174,106 | 11/1979 | Moser | 273/442 |
| 4,254,576 | 3/1981 | Matsumoto et al. | 446/444 |
| 4,383,688 | 5/1983 | Prehodka . | |
| 4,550,910 | 11/1985 | Goldfarb et al. | 446/444 X |
| 5,435,553 | 7/1995 | Arima et al. | 273/442 X |
| 5,441,435 | 8/1995 | Shiraishi | 446/476 X |

*Primary Examiner*—Raleigh W. Chiu

[57] ABSTRACT

An obstacle course for remotely controlled toy vehicles. A plurality of track circuits are arranged in tiered fashion upon a core support structure. Each track circuit has obstacles such as pits, rocks, and traps which must be negotiated to complete a challenge level. Upon successful completion of a particular challenge on one of these track circuits, the vehicle may advance to the next higher track circuit through an up ramp. There a new challenge in the form of different obstacles are presented. The obstacle course ends on a top face of the support structure which allows direct head-to-head confrontations to determine a winner should all vehicles in a competition successfully complete the obstacle portion of the course. Optional clock timers may set a time limit for completion of the course as a whole or any given level.

15 Claims, 6 Drawing Sheets

TIERED OBSTACLE COURSE SYSTEM FOR REMOTELY CONTROLLED VEHICLES

BACKGROUND OF THE INVENTION

1. Field of the Invention

The present invention relates to obstacle courses. More specifically, the present invention relates to obstacle courses having a plurality of challenge levels for competing remotely controlled vehicles.

2. Description of the Prior Art

In a typical course for toy vehicles, there is a beginning line behind which the vehicles start, and an end line for which the vehicles vie to cross first. The course may be of a certain length or it may be continuous, in which a set number of laps about a circuit must be run. Though variations in courses can add interest, such as with twists, turns, and jumps, the basic race concept is maintained.

Prior patents have described various race courses that include obstacles. For example, U.S. Pat. No. 3,502,332, issued March 24 to T. Wolf, describes an obstacle raceway that includes a spaced apart jump. U.S. Pat. No. 4,383,688, issued May 17, 1983 to B. Prehodka, describes an obstacle for toy vehicle tracks that will throw a colliding vehicle off the track.

U.S. Pat. No. 3,820,788, issued Jun. 28, 1974 to A. Goldfarb et al., describes an up-hill racing game that includes impact-propelling mechanisms for incrementally moving racing pieces through the course.

SUMMARY OF THE INVENTION

The present invention relates to an obstacle course for remotely controlled toy vehicles in which successive obstacle challenges are presented to each vehicle by the course in a tiered multi-level system of track circuits. Upon successful completion of a particular challenge on one of these track circuits, the vehicle may advance to the next higher track circuit through an up ramp. There a new challenge in the form of different obstacles are presented. As their vehicle is negotiating the course, competitors carrying their remote controllers may move around the entire course to better view and react to each new challenge. The present invention also provides a system which allows direct head-to-head confrontations to determine a winner should all vehicles in a competition successfully complete the obstacle portion of the course. Though not a race challenge between vehicles, as typical in the prior art, the present system may use clock timers to set a time limit for completion of the course as a whole or any given level.

Accordingly, it is a principal object of the invention to provide a obstacle course system with multiple challenge levels in a compact tiered layout.

It is another object of the invention to provide a course in which diverse obstacles are presented to engage and maintain interest.

It is a further object of the invention to provide a system in which the support structure for track circuits is integrated into the system to provide a stage for head-to-head confrontations.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
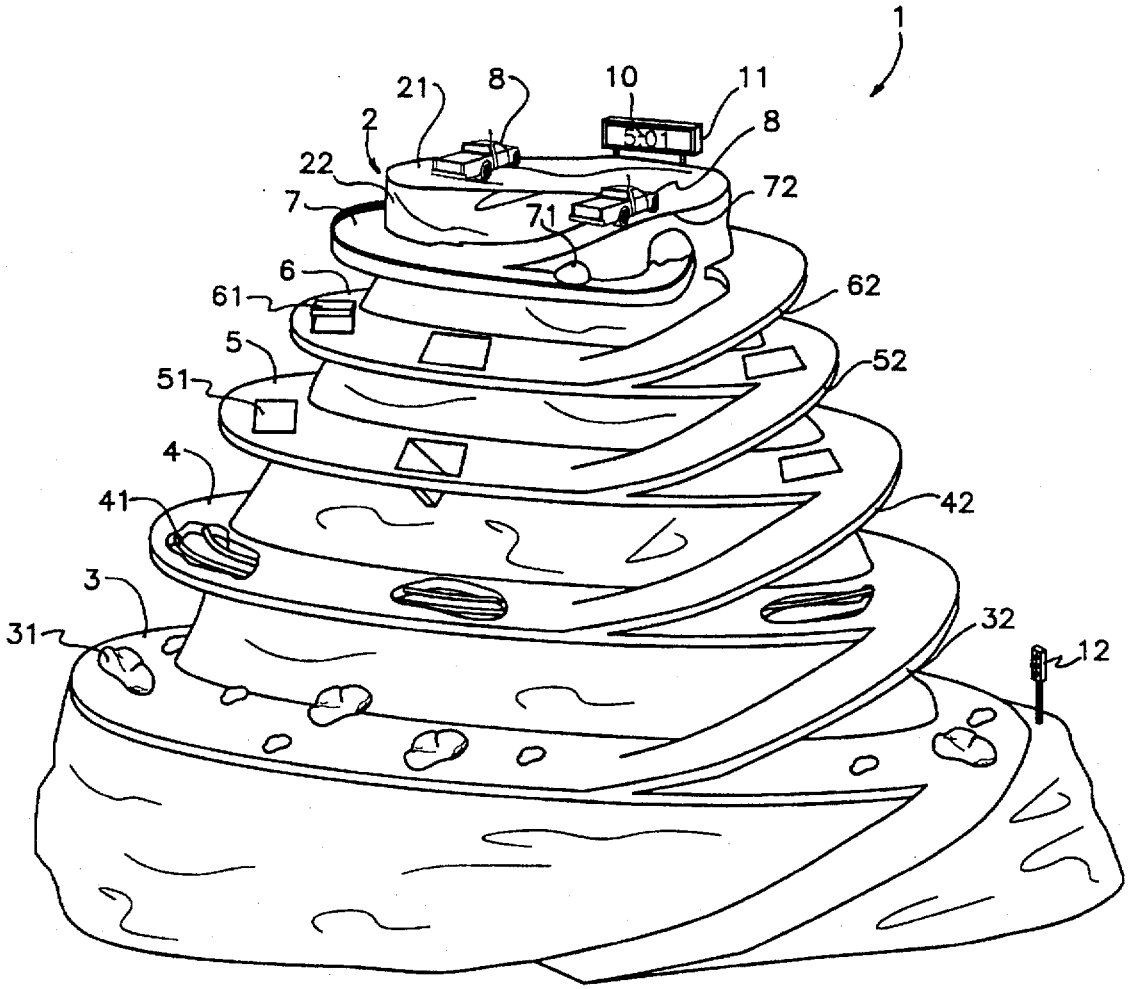
FIG. 1 is a perspective view of one preferred embodiment of an obstacle course according to the present invention.

As seen in FIG. 1. the present invention is a competition system for remotely controlled vehicles that includes an obstacle course 1 having a support structure 2 with a top face 21 and sides 22. A plurality of track circuits 3, 4, 5, 6, and 7 are disposed in tiers around the support structure. Each track circuit includes a plurality of obstacles 31, 41, 51, 61, and 71 which must be negotiated to complete the circuit. Ramps 32, 42, 52, and 62, interconnect track circuits of successive tiers, and a top ramp 72 connects the top track circuit 7 to the top face of the support structure. A plurality of remotely controllable toy vehicles 8 are used on the course for competition.

As shown in the figure, the support structure is preferably a simulative mountain, though simulations of other environments with a vertical component, such as towers, stadiums, and other buildings may be used. The top face 21 of the support structure is substantially horizontal in orientation, but need not be completely flat. This top face serves as a platform for head-to-head confrontations between vehicles which have successfully finished the obstacle portion of the competition. Here, each vehicle strives to push other vehicles off the top face to become the victor.

Track circuits are secured to the support structure's sides to provide a stable platform. Though the support structure is shown with a substantially circular cross-section, any other regular or irregular shape may be used. Preferably, the sides slope outwardly from the top face and the track circuits increase in diameter from top to bottom. This allows a substantially unobstructed view of each track circuit. The track circuits may be permanently secured to the support structure. Alternatively, track circuits may be provided in sections which may be detachably locked to the support structure through any appropriate mechanism.

To allow advancement from one track circuit to the next higher circuit, at least one ramp is provided therebetween. One advantage of a tiered structure is that multiple starting positions may be provided for each vehicle around a given track circuit without giving any advantage to any vehicle, per se. If such is desired, multiple ramps between track circuits may be used, one for each starting position. Further, vehicles need not travel in the same direction around a track circuit to complete the challenge level it defines. This allows for more potential confrontations between vehicles in the competition. Ramps may accordingly be provided in both directions from one or more positions along the track circuit.

Figure 2:
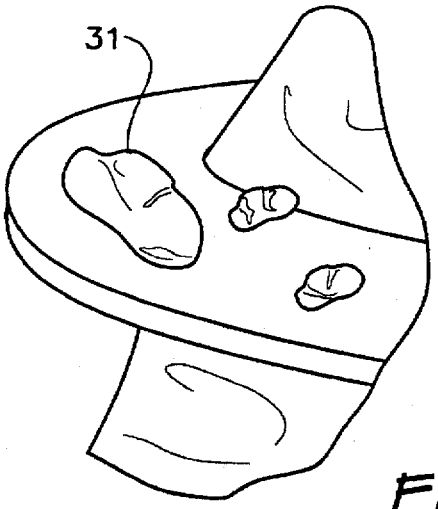

The obstacles which may be used along a track circuit include embedded rocks, moving rocks, pits, trap doors, and spring doors. Preferably, a different obstacle is selected for each track circuit. As shown in FIG. 2, one such obstacle may be a plurality of embedded rocks 31 protruding upwardly and outwardly from the surface of a track circuit. Preferably, the rocks are of different shapes and sizes to simulate rough terrain.

Figure 3:
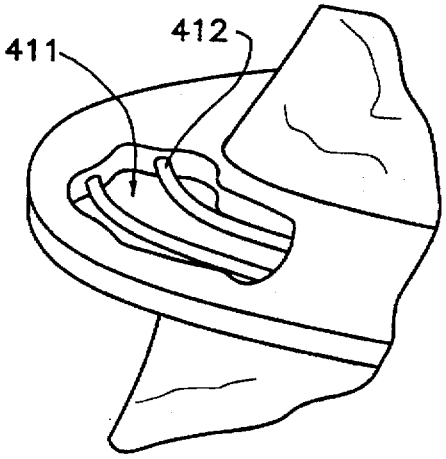

As shown in FIG. 3, another obstacle may be pits 41 which are defined in the track circuit with pit openings 411 of sufficient size to disallow travel by one of the toy vehicles 8 therearound. To negotiate these pits a plurality of transverse beams 412 are provided across each pit opening.

Figure 4:
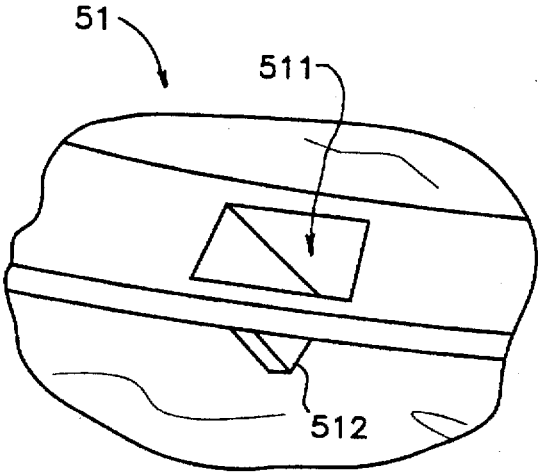
FIGS. 2–6 are partial perspective views of various obstacles according to the present invention.

As shown in FIG. 4, trap door obstacles 51 includes a trap door 512 overlying a trap opening 511 through the track. Trap opening 511 is sized such that vehicle 8 will drop therethrough. Door 512 may be attached to the track along any one side of the opening, such as through a hinge or living hinge and will open from the weight of the vehicle.

Figure 5:
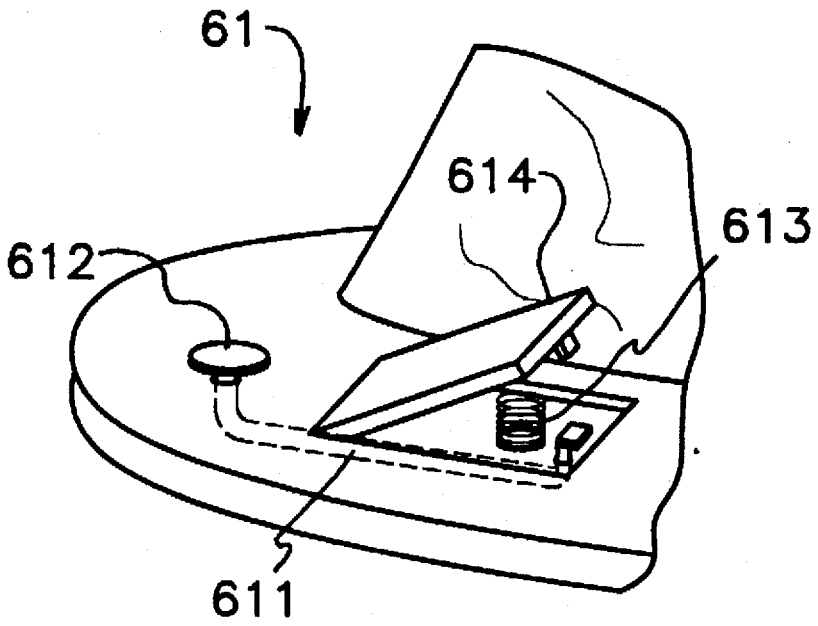

As shown in FIG. 5, another obstacle is a spring door obstacle 61 capable of ejecting a toy vehicle off a track circuit. A spring 613 pushes a spring door 614 upward when a triggering mechanism such as door latch 611 is activated by passage of a vehicle over a door trigger 612.

Figure 6:
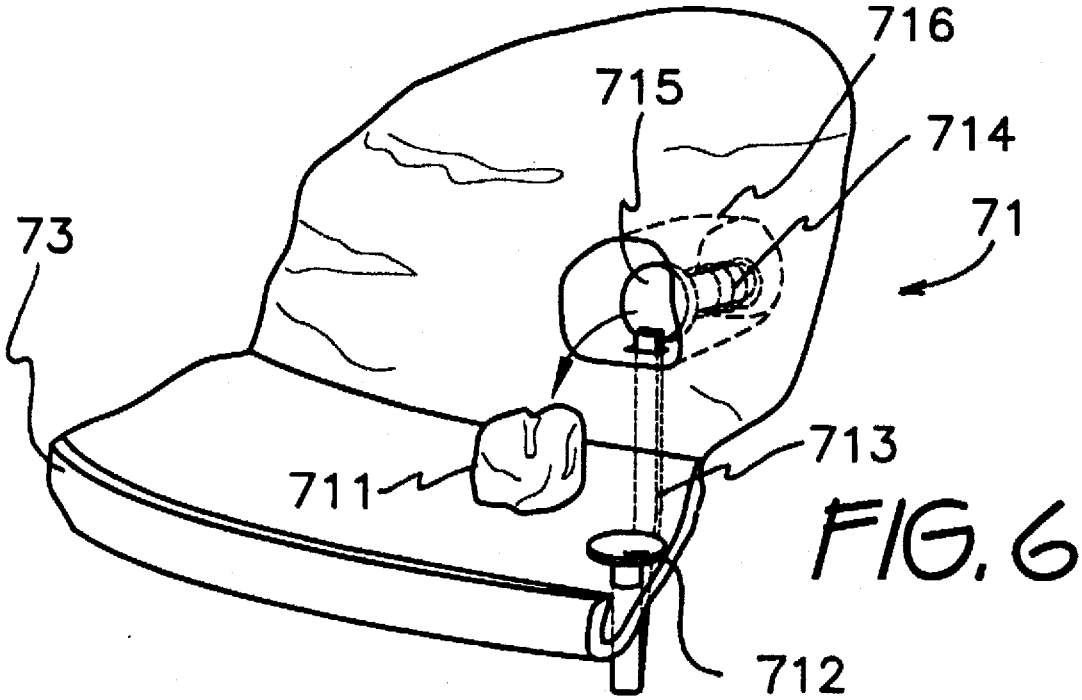

As shown in FIG. 6, a moving rock or boulder obstacle 71 includes a rock 711 which is ejected onto a track in response to a triggering mechanism activated by passage thereover by a vehicle. An ejector latch 712 and ejector trigger 713 may be used, similar to the spring door obstacle above. In this case a plumber spring 714 urges a plunger 715 outward thereby ejecting rock or boulder 711 out of a cavity 716. The track circuit for such an obstacle may include an outer lip 73 to keep the moving rock or boulder on track. As seen in FIG. 1, a track circuit 7 with a slight downward grade may be used to keep an ejected rock or boulder rolling.

In addition to the obstacles the course may include various displays, and indicators to assist in running a competition. As seen in FIG. 1, a clock timer 11 and associated display 10 may be used to regulate the competition by setting time limits for completion. Further, signals such as signal light 12 may be used to indicate commencement of competitions. Signals may be synchronized with the clock timer through any appropriate electrical or remote communication therebetween.

Figure 7:
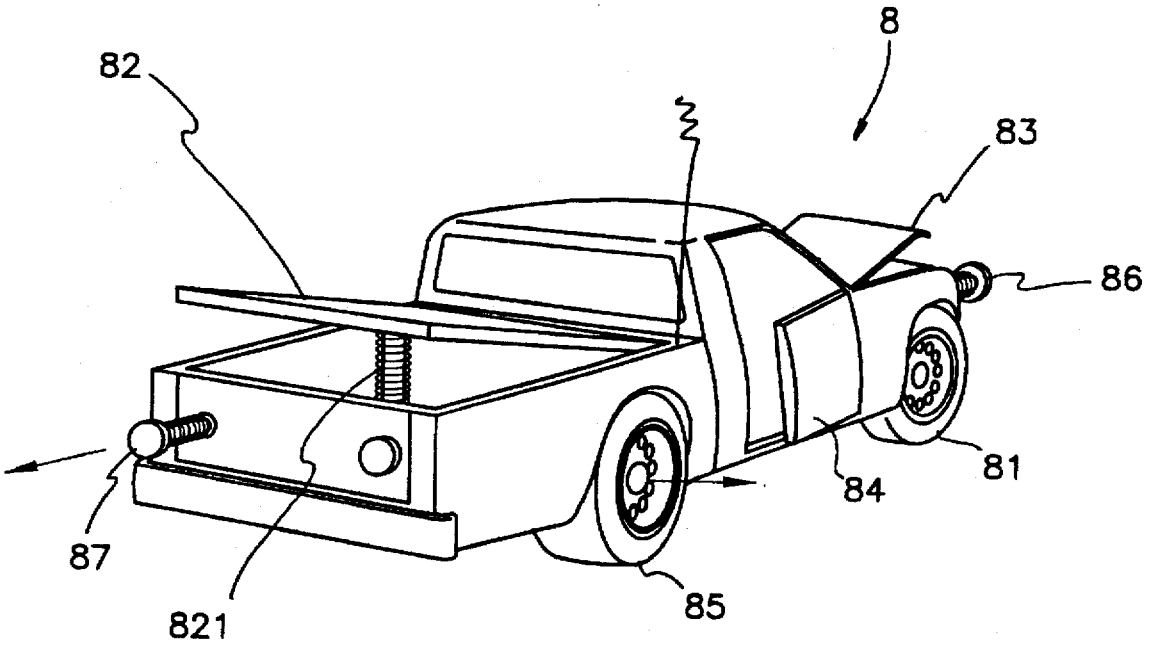
FIG. 7 is a perspective view of a toy vehicle according to the system of the present invention.
Figure 8:
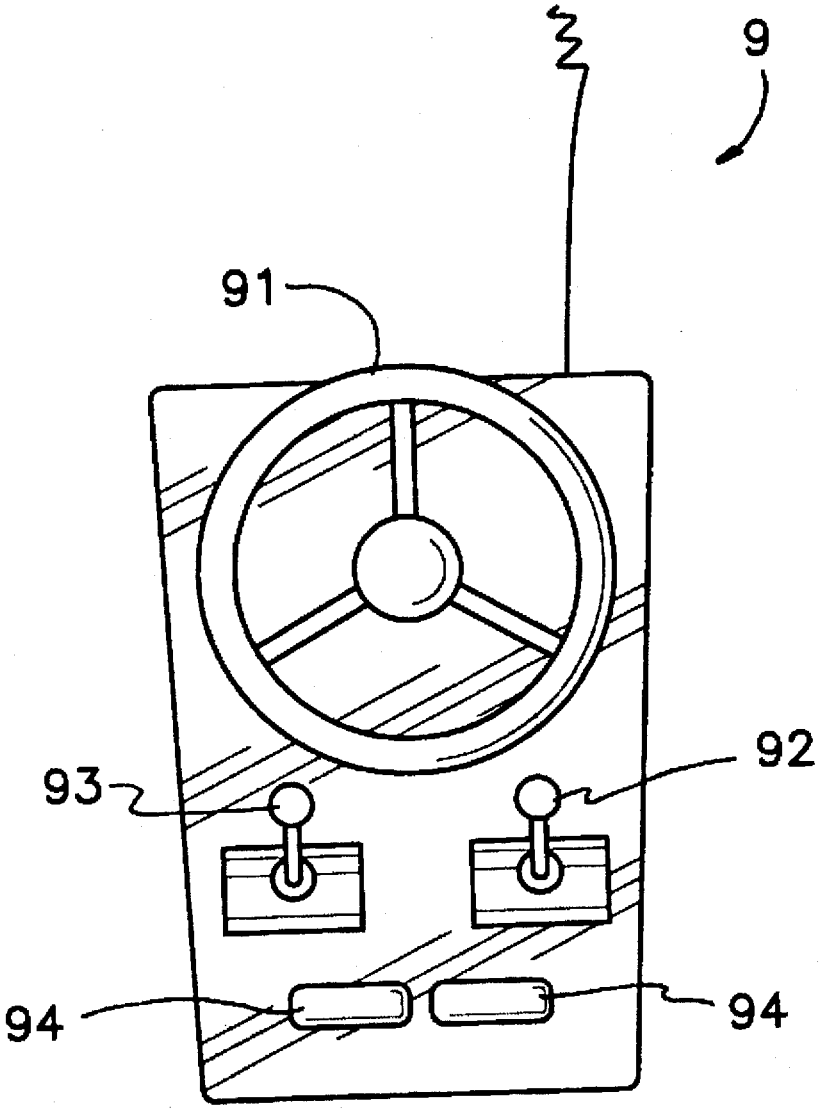
FIG. 8 is a perspective view of a controller for a toy vehicle according to the system of the present invention.

As best seen in FIGS. 7 and 8, a toy vehicle 8 and controller 9 are used in the present system. The vehicle is preferably a simulative truck with all-terrain style tires 81 as shown, but other types and styles of wheeled vehicles may be used. To properly negotiate the course of the present invention, the vehicle is preferably equipped with a plurality of forward speeds and at least one reverse speed, in addition to steering. Both selection of speed and control of steering are remotely operated through controller 9. Steering may be controlled with a wheel 91, as shown, through a pad control, joystick, double levers, or the like. Selection of speeds may be accomplished through switches 92 and 93 as shown, buttons, or the like.

Further, to enhance toy vehicles 8 for the present head-to-head competition system, one or more spring actuated extendable part may be provided. The spring actuated extendable part may be a trunk 82, hood 83, doors 84, wheels 85, headlight assemblies 86, or tail light assemblies 87. The controller is provided with corresponding selectors, such as buttons 94, for each extendable part. Preferably, a spring, such as trunk spring 821 for trunk 82, is used to extend a part. Most preferably, the part is attached to the spring to avoid loss. A latching mechanism mat be used to hold the extendable part agains the remainder of the vehicle until selected. These extendable parts may be used to fend off obstacles or other vehicles in a defensive manner, or to provide extra force in the head-to-head confrontation at the top side of the support structure.

It is to be understood that the present invention is not limited to the any single embodiment described above, but encompasses any and all embodiments within the scope of the following claims.

I claim:

1. A multi-level obstacle course for competitions between remotely controlled toy vehicles, said course comprising:

a support structure having a top face and sides;

a plurality of track circuits disposed in tiers around the sides of said support structure such that a top track circuit is defined closest to said top face;

a plurality of obstacles on each of said track circuits;

at least one ramp interconnecting track circuits of successive tiers; and at least one ramp connecting the top track circuit to said top face of said support structure.

2. The course according to claim 1, wherein said support structure is a simulative mountain.

3. The course according to claim 1, wherein each obstacle of said plurality of obstacles is selected from the group consisting of embedded rocks, moving rocks, pits, trap doors, and spring doors.

4. The course according to claim 3, wherein a different obstacle is selected for each one of said track circuits.

5. The course according to claim 3, wherein at least one obstacle is a trap door overlying a trap opening through one of said track circuits, said trap opening sized to pass one of said toy vehicles.

6. The course according to claim 3, wherein at least one obstacle is a pit having a pit opening through one of said track circuits of sufficient size to disallow travel by one of said toy vehicles therearound, and a plurality of transverse beams across said pit opening.

7. The course according to claim 3, wherein at least one obstacle is a moving rock ejected onto one of said track circuits in response to a triggering mechanism activated by passage thereover by one of said toy vehicles.

8. The course according to claim 3, wherein at least one obstacle is a spring door for ejecting one of said toy vehicles off one of said track circuits, said spring door activated by passage over a triggering mechanism by one of said toy vehicles.

9. The course according to claim 3, wherein at least one obstacle is a plurality of embedded rocks protruding upwardly and outwardly from one of said track circuits.

10. The course according to claim 1, further comprising signals disposed at the beginning of one of said track circuits for indicating commencement of competitions.

11. The course according to claim 1, further comprising a clock timer and a timer display mounted on said support structure.

12. A tiered obstacle course competition system comprising:

an obstacle course having a support structure with a top face and sides, a plurality of track circuits disposed in tiers around the sides of said support structure such that a top track circuit is defined closest to said top face, a plurality of obstacles on each of said track circuits, at least one ramp interconnecting track circuits of successive tiers, and at least one ramp connecting the top track circuit to said top face of said support structure;

a plurality of remotely controllable toy vehicles; and a remote controller for each of said toy vehicles.

13. The competition system of claim 12, wherein:

each of said toy vehicles has a plurality of forward speeds, at least one reverse speed, and steering; and said controller includes means for controlling the steering and for selecting from the forward and reverse speeds.

14. The competition system of claim 12, wherein each of said toy vehicles has at least one spring actuated extendable part activatable through said controller.

15. The competition system of claim 14, wherein said spring actuated extendable part is selected from trunks, hoods, doors, wheels, headlight assemblies, and tail light assemblies.

* * * * *